US007437993B2

(12) United States Patent
Kulpa

(10) Patent No.: US 7,437,993 B2
(45) Date of Patent: Oct. 21, 2008

(54) POSTAGE METER WITH IMPROVED PRINTING SLOT

(75) Inventor: Walter J. Kulpa, Trumbull, CT (US)

(73) Assignee: Pitney Bowes Inc., Stamford, CT (US)

( * ) Notice: Subject to any disclaimer, the term of this patent is extended or adjusted under 35 U.S.C. 154(b) by 384 days.

(21) Appl. No.: 11/234,325

(22) Filed: Sep. 23, 2005

(65) Prior Publication Data

US 2007/0068401 A1 Mar. 29, 2007

(51) Int. Cl.
*B41L 47/46* (2006.01)

(52) U.S. Cl. ..... 101/91; 101/71

(58) Field of Classification Search ..... None
See application file for complete search history.

(56) References Cited

U.S. PATENT DOCUMENTS 4,557,348 A * 12/1985 Mifsud ..... 181/120
4,579,054 A * 4/1986 Buan et al. ..... 101/91
5,378,070 A * 1/1995 Lyga ..... 400/615.2
5,572,393 A * 11/1996 Church et al. ..... 360/130.21
5,806,994 A 9/1998 Coffey et al. ..... 400/120.01
5,844,584 A * 12/1998 Murphy et al. ..... 347/20
6,004,498 A * 12/1999 Fujii et al. ..... 264/255
6,530,632 B1 3/2003 Writt ..... 347/2
2002/0021931 A1* 2/2002 Herbert ..... 400/622
2002/0085871 A1 7/2002 Salomon et al. ..... 400/635
2007/0068401 A1* 3/2007 Kulpa ..... 101/91

FOREIGN PATENT DOCUMENTS

DE 100 32 856 A1 1/2002
FR 2742693 6/1997

* cited by examiner

*Primary Examiner*—Daniel J. Colilla
*Assistant Examiner*—David Banh
(74) *Attorney, Agent, or Firm*—George M. Macdonald; Angelo N. Chaclas

(57) ABSTRACT

A postage meter includes a slot to receive insertion of an envelope. A registration plate defines a top side of the slot. The registration plate has a window formed therein. The registration plate is for defining a printing location for a top surface of the envelope. A print head is mounted above the registration plate for printing a postage indicium on the top surface of the envelope. The postage meter includes a spring-loaded platform for pressing the envelope against the registration plate. The platform has a recess therein facing the window in the registration plate. The recess has a depth of at least about 5 mm. A cantilever spring is positioned between the window and the recess to apply an upward force to the envelope.

20 Claims, 5 Drawing Sheets

POSTAGE METER WITH IMPROVED PRINTING SLOT

BACKGROUND

This invention relates generally to postage meters and more particularly is concerned with postage meters of the type that includes an ink jet print head above a registration plate.

In one conventional variety of postage meter, an ink jet print head is employed to print a postage indicium on an envelope. The ink jet print head is moved on a path above the top surface of the envelope and emits ink in a downward direction toward the envelope. To ensure proper printing, the vertical spacing between the envelope surface and the print head is critical. A horizontal registration plate positioned below the print head defines the ideal spacing between the print head and the envelope surface. A spring-loaded platform below the envelope presses the envelope upwardly against the registration plate. A window is formed in the registration plate and the ink from the print head is propelled through the window at the top surface of the envelope to form the postage indicium.

A potential problem with postage meters of this type is that envelopes having a "puffy" cross-section may, when pressed by the platform, partially enter through the window in the registration plate. When this occurs, the top surface of the envelope may enter through the window to such an extent that the envelope comes into contact with the print head. When this occurs, damage to the print head may result, as well as smearing of the postage indicium.

One way of reducing the possibility of entrance of a puffy envelope into the window is to limit the size of the window so that the edge of the window is spaced a sufficient distance in a horizontal direction from the edge of the envelope. However, limiting the size of the window may prevent printing of as large a postage indicium as would be desirable.

SUMMARY

Accordingly, an improved postage meter is provided. The postage meter includes a slot to receive insertion of an envelope, and a registration plate which defines a top side of the slot. The registration plate has a window formed therein. The registration plate defines a printing location for a top surface of the envelope. The postage meter further includes a print head mounted above the registration plate. The print head is for printing a postage indicium on the top surface of the envelope. The postage meter also includes a spring-loaded platform which has a recess therein facing the window. The recess has a depth of at least about 5 mm (millimeters).

The postage meter may also include a cantilever spring positioned between the window and the recess. The cantilever spring is for applying an upward force to the envelope. The lower edge of the cantilever spring may be secured to the floor of the recess. The cantilever spring may be a metal sheet, formed, e.g., of stainless steel.

The postage meter may also include a switch adjacent the slot. The switch may be for being contacted by the envelope to actuate the print head. The postage meter may also include a ramp at an end of the recess to guide the envelope to the switch. As an alternative to the ramp, the cantilever spring may have a length extent that is substantially equal to the length extent of the spring-loaded platform.

The print head may be an ink jet print head.

In another aspect, a postage meter includes a slot to receive insertion of an envelope, and a registration plate which defines a top side of the slot. The registration plate has a window formed therein. The registration plate defines a printing location for a top surface of the envelope. The postage meter further includes a print head mounted above the registration plate. The print head is for printing a postage indicium on the top surface of the envelope. The postage meter also includes a spring-loaded platform. The spring-loaded platform is for pressing the envelope against the registration plate. The postage meter also includes a cantilever spring that is at least partially in the slot. The cantilever spring is for applying an upward force to the envelope.

Therefore, it should now be apparent that the invention substantially achieves all the above aspects and advantages. Additional aspects and advantages of the invention will be set forth in the description that follows, and in part will be obvious from the description, or may be learned by practice of the invention. Various features and embodiments are further described in the following figures, description and claims.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION

The present invention is concerned with a postage meter in which a spring-loaded platform for pressing an envelope against a registration plate includes a recess to better accommodate puffy envelopes, to make it less likely that the platform will cause the envelopes to enter through the window in the registration plate. To prevent relatively thin envelopes from sinking into the recess, a cantilever spring is provided on the spring-loaded platform to support thin envelopes in proper position at the registration plate.

With the recess provided in the spring-loaded platform, the size of the window in the registration plate can be increased to allow for printing of a larger postage indicium, without a significant increase in the risk that the spring-loaded platform will push puffy envelopes through the window. At the same time, the presence of the cantilever spring on the platform allows thin envelopes to be processed properly, notwithstanding the presence of the recess in the platform.

Figure 1:
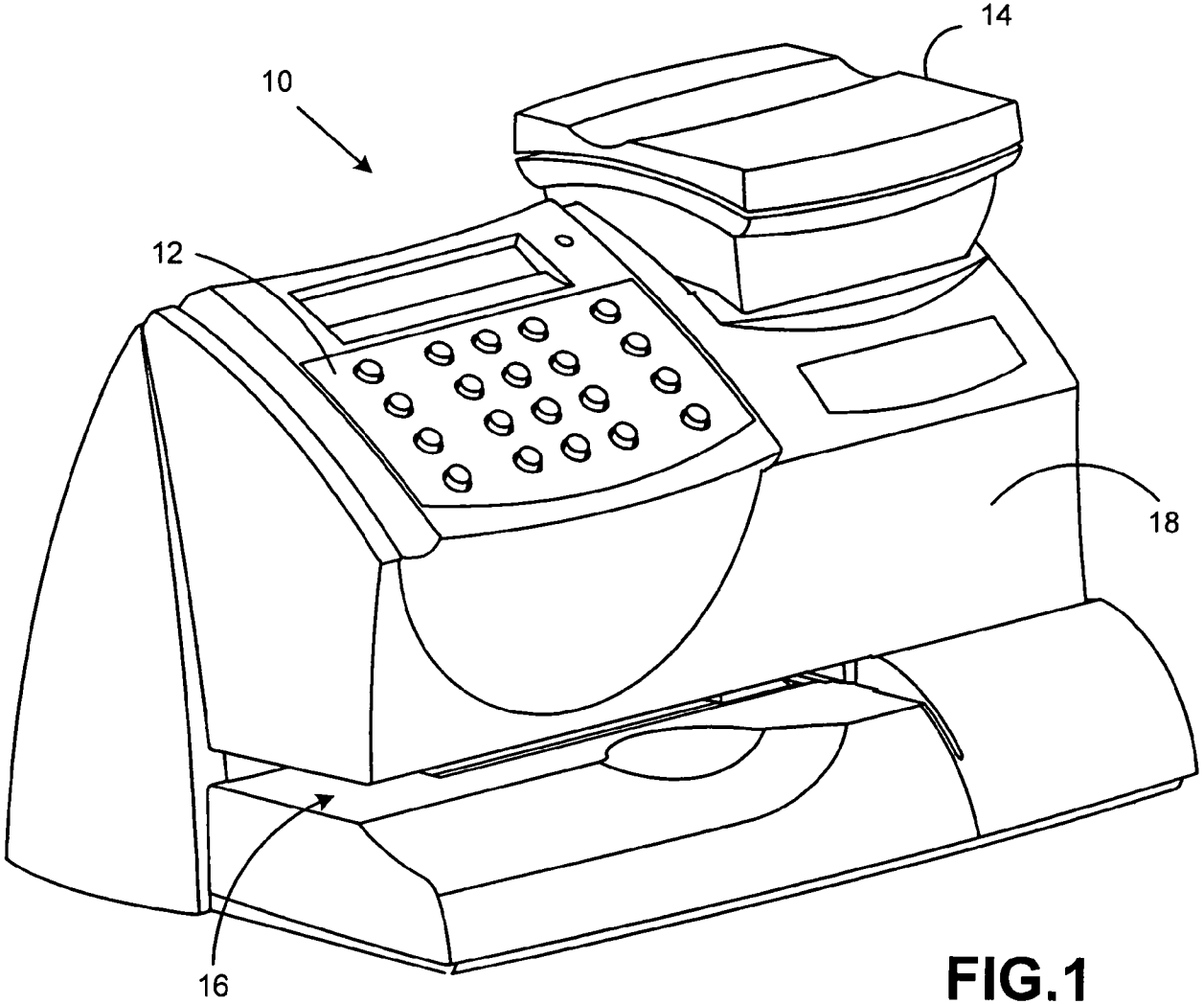
FIG. 1 is an isometric view of a postage meter provided according to the invention.

Referring now to the drawings, and particularly to FIG. 1, the reference numeral 10 indicates generally a postage meter provided in accordance with the present invention. The postage meter 10 includes a control panel 12, by which an operator may interact with the postage meter 10. In addition, the postage meter 10 includes an integrated scale platform 14. The scale platform 14 is provided to weigh a mailpiece (not shown in FIG. 1) and to provide weight data to a control circuit (not shown) which controls setting of the postage meter to print an appropriate amount of postage on the mailpiece.

The postage meter 10 also includes a slot 16 formed in the housing 18 of the postage meter 10. The purpose of the slot 16 is to receive insertion of an envelope (not shown in FIG. 1) upon which a postage indicium is to be printed by the postage meter.

Figure 2:
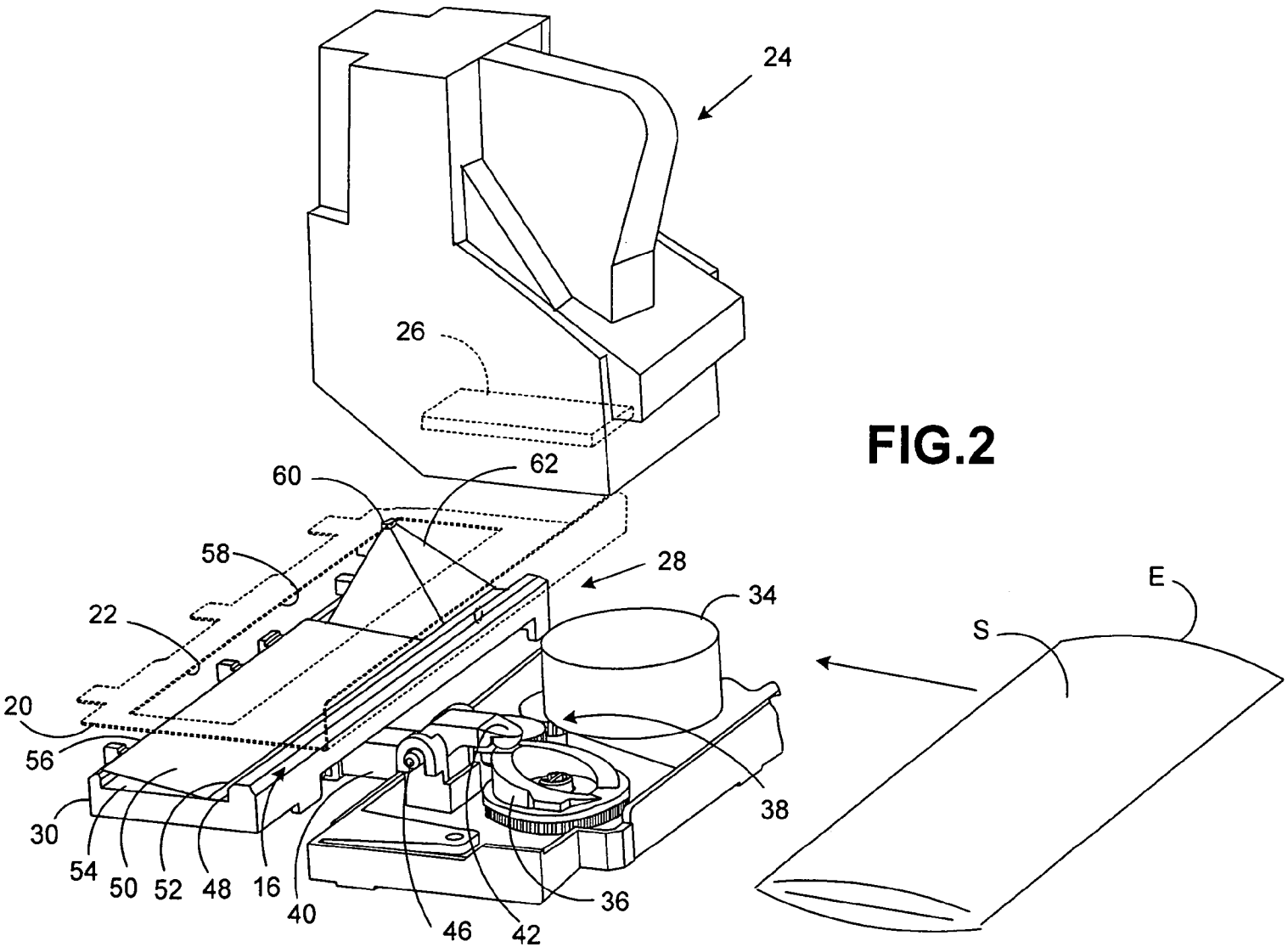
FIG. 2 is a partial, and partially exploded, view of print-related components of the postage meter of FIG. 1.

FIG. 2 is a partial, and partially exploded, view of print-related components of the postage meter 10.

As seen in FIG. 2, the postage meter 10 further includes a registration plate 20 (shown in phantom) that defines a top side of the envelope insertion slot 16. The registration plate 20 has a window 22 formed therein. As is conventional, the purpose of the registration plate 20 is to define a printing location for the top surface S of an envelope E. (The envelope E shown in the drawings has a rather puffy cross-section to aid in illustrating certain aspects of the invention.)

Also included in the postage meter 10 is a print module 24 that includes an ink jet print head 26. In accordance with conventional practices, the print head 26 is operable to propel ink downwardly through the window 22 in the registration plate 20 to form a postage indicium (not shown) on the top surface S of the envelope E once the envelope E has been inserted in the slot 16.

The postage meter 10 further includes a registration mechanism (generally indicated at 28 in FIG. 2) which operates to register the envelope E against the bottom surface of the registration plate 20 after the envelope E is inserted in the slot 16 and prior to printing of the postage indicium. The registration mechanism 28 includes a spring-loaded platform 30. The springs that load the platform 30 are not shown in FIG. 2, but are schematically represented at 32 in FIGS. 3-5. As best seen from FIGS. 4 and 5, the springs 32 are configured to upwardly bias the platform 30.

The registration mechanism 28 also includes a motor 34 and a part-cylindrical cam 36 coupled to the motor 34 via a gear train 38. The registration mechanism 28 further includes a tilting follower arm 40 (best seen in FIGS. 4 and 5). The follower arm has a first end 42 that follows the cam 36 and a second end 44 that is coupled to the platform 30. The follower arm 40 is pivotable around a pivot point 46.

The registration mechanism 28 generally operates in accordance with conventional principles, but departs from conventional designs in the following two respects: First, the platform 30 has a recess 48 formed in a top surface thereof, facing the window 22 in the registration plate 20; and second, a cantilever spring 50 is provided in the slot 16. In addition, the window 22 may be larger than is conventional.

To accommodate puffy envelopes that may be processed in the postage meter 10, the recess 48 may have a depth of at least about 5 mm. The horizontal extent of the recess 48 may be generally commensurate with the horizontal extent of the window 22 in the registration plate 20, so that the platform comes into contact with the bottom surface of the envelope only in areas that are below solid portions of the registration plate. With the presence of the recess 48, the platform 30 is less likely to push the top surface of the envelope up through the window 22 in the registration plate 20. Accordingly, if desired, it may be feasible to increase the size of the window 22, to allow for printing of larger postage indicia, without unduly increasing the risk of the envelope entering into the window 22, contacting the print head 26, etc.

The cantilever spring 50 may be secured by its lower edge 52 (FIG. 2) to the floor 54 of the recess 48. The cantilever spring 50 may, for example, be a generally planar and rectangular flexible metal sheet. For example, the cantilever spring 50 may be formed of stainless steel of the grade 400 series and with a thickness of about 7 thousandths of an inch. The cantilever spring material may have been hardened to increase the tensile strength thereof. The cantilever spring 50 may be secured to the floor 54 of the recess 48 of the platform 30 by a technique such as heat-staking, or may be secured by clips (not shown) or screws (not shown). The cantilever spring 50 may be inclined upwardly from its lower edge toward the rear of the slot 16 by an angle of about 7° to 8° (the angle is not critical). The cantilever spring 50 may extend sufficiently in a horizontal direction such that the upper edge 56 (which is the rear edge) of the cantilever spring 50 extends beyond the rear edge 58 (FIG. 2) of the window 22.

One function of the cantilever spring 50 is to guide the envelope E so that it does not come into contact with the rear wall of the recess 48. In addition, the cantilever spring 50 applies a gentle upward force to the envelope E during registration of the envelope E against the registration plate. In a case where the envelope is relatively thin, the force applied thereto by the cantilever spring 50 may be sufficient to keep the envelope from drooping into the recess 48, helping to assure proper registration. In the case of a thick or puffy envelope, the force applied by the cantilever spring 50 is not so strong that the envelope will be pushed up through the window 22 in the registration plate.

Referring once more to FIG. 2, and in accordance with conventional practices, the postage meter 10 may include a switch (schematically represented at 60) adjacent the slot 16. The switch 60 is provided to be contacted by the envelope E when the envelope E is inserted into the slot 16. Contact of the envelope with the switch 60 actuates a print cycle. In the print cycle, the motor 34 is actuated to register the envelope E against the registration plate 20 and then the print head 26 is actuated to print the postage indicium on the envelope E. Also in accordance with conventional practices, the postage meter 10 includes a ramp 62 at the end of the recess 48 to guide the envelope E to the switch 60.

In an alternative embodiment (not shown), the ramp 62 is omitted and the cantilever spring 50 extends to reach the location where the ramp 62 is shown so that the cantilever spring 50 can perform the function of guiding the envelope to the switch 60. That is, in the latter embodiment, the cantilever spring 50 has a length extent that is substantially equal to the length extent of the window 22 in the spring-loaded platform 30.

Figure 3:
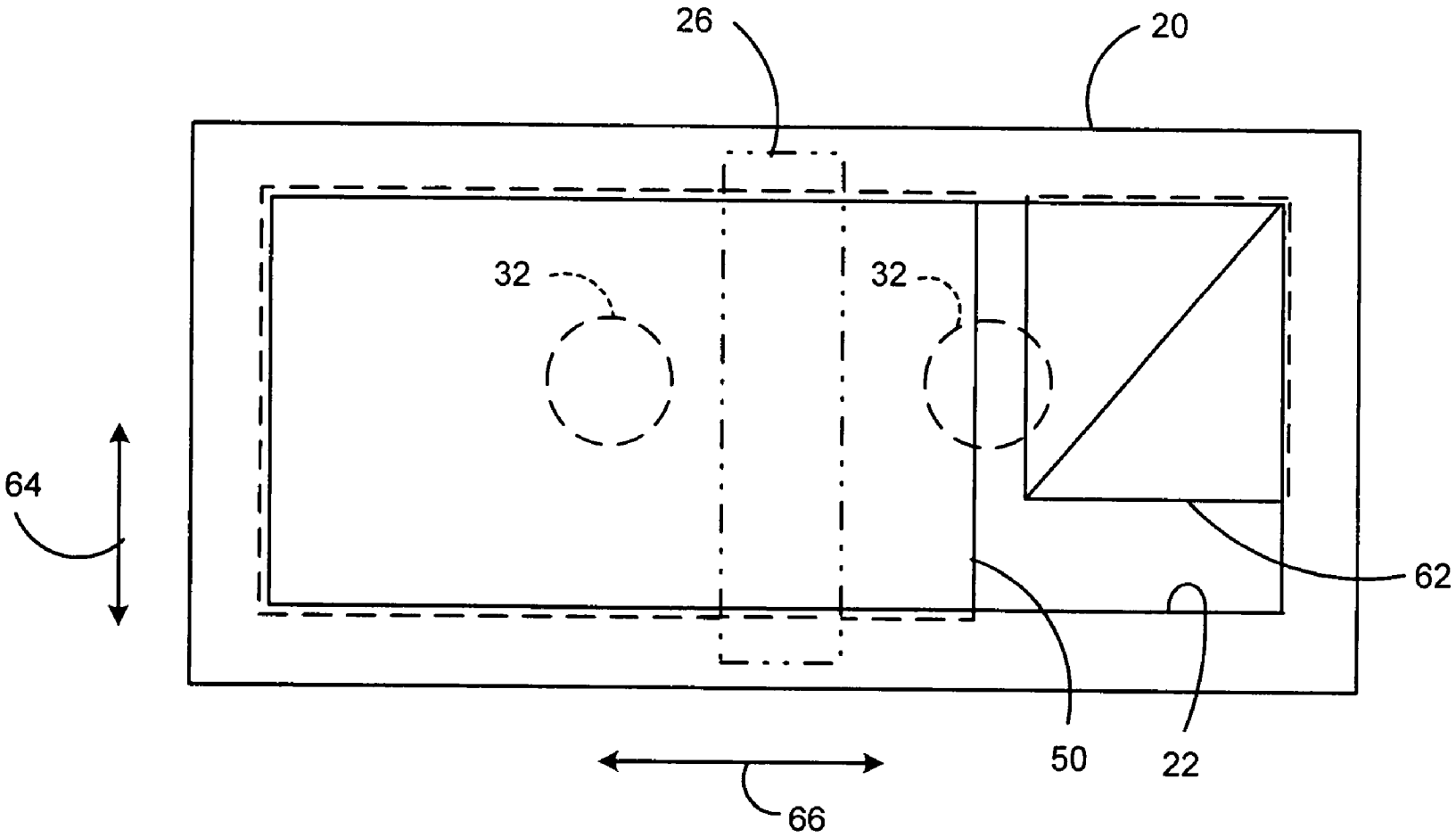
FIG. 3 is a schematic plan view showing some of the print-related components of FIG. 2.

FIG. 3 is a schematic plan view showing some of the print-related components of the postage meter 10. In particular, FIG. 3 shows the spatial inter-relationships among the registration plate 20, the cantilever spring 50, the ramp 62, the print head 26 and the springs 32. The spring-loaded platform itself is not shown in the drawing so that the drawing is simplified. Arrow mark 64 in FIG. 3 indicates the horizontal directions in which the envelope (not shown in FIG. 3) is inserted into and removed from the printing slot. Arrow mark 66 indicates the horizontal directions in which the print head 26 traverses the window 22 in the registration plate 20. It will be recognized that, since the print head 26 moves during printing, the position of the print head shown in FIG. 3 is only an example of the various positions of the print head during the print cycle.

Operation of the postage meter will now be described.

Prior to insertion of the envelope E into the slot 16, the platform 30 is in its home or ready position (shown in FIG. 4), retracted from the registration plate 20 to permit insertion of the envelope E. Holding of the platform 30 in its home position is accomplished as follows: Cam 36 is positioned so that the high end of the cam 36 holds up the first end 42 of the follower arm 40, thereby holding down the second end 44 of the follower arm 40. Since the second end 44 of the follower arm 40 is linked to the platform 30, the platform 30 is held down by the arm 40 against the upward biasing force of the springs 32.

Entry of weight and rating information to set the meter may be performed in a conventional manner. The operator then inserts the envelope E into the slot 16 (FIG. 2). The ramp 62 guides the rear edge of the envelope to contact and trip the switch 60. Tripping of the switch 60 actuates the motor 34 to rotate the cam 36 so that the high end of the cam no longer holds up the end 42 of the follower arm 42. Consequently, the platform 30 is released and is pushed upwardly by the springs 32 to register the top surface of the envelope against the bottom surface of the registration plate 20, as shown in FIG. 5.

Figure 4:
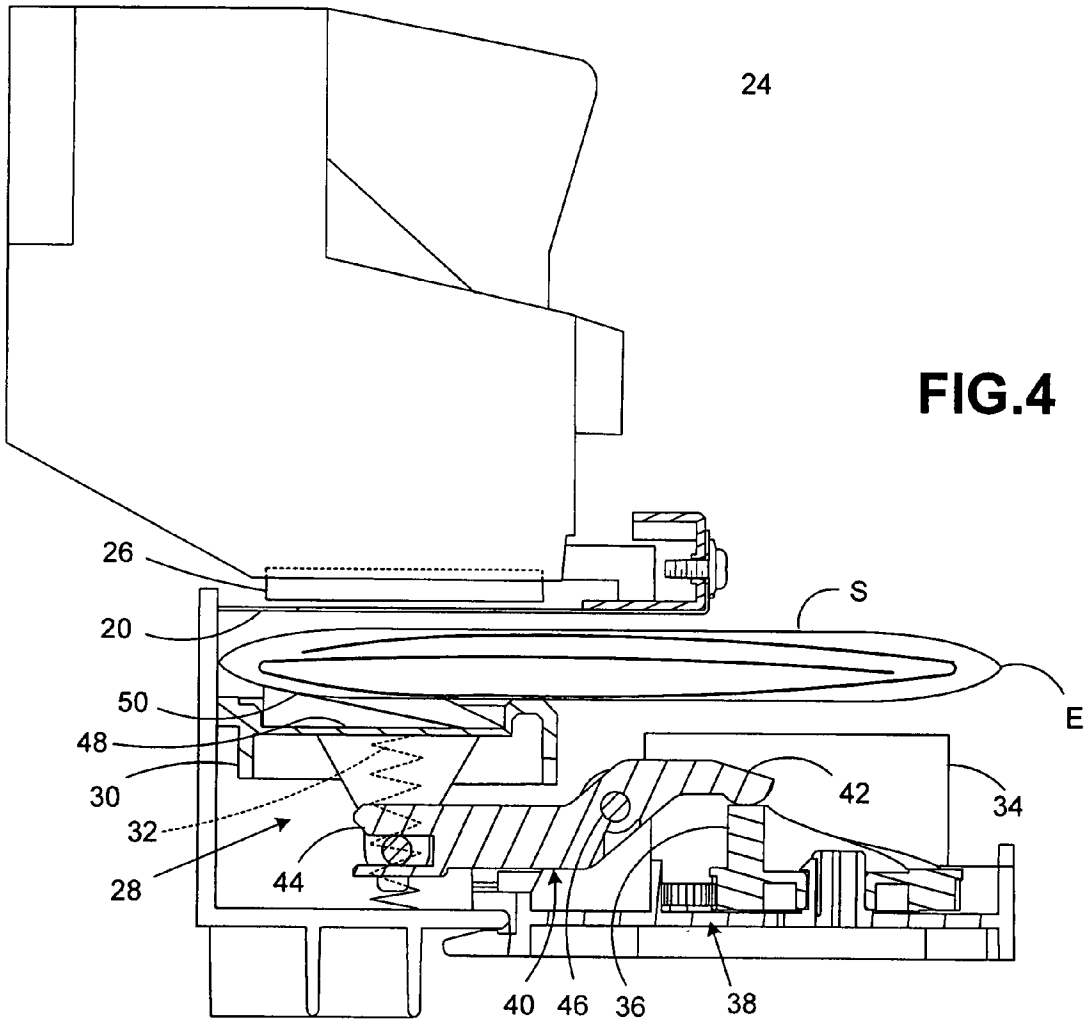
FIG. 4 is a side cross-sectional view of the print-related components of FIG. 2, in a condition to allow insertion of an envelope into the postage meter.
Figure 5:
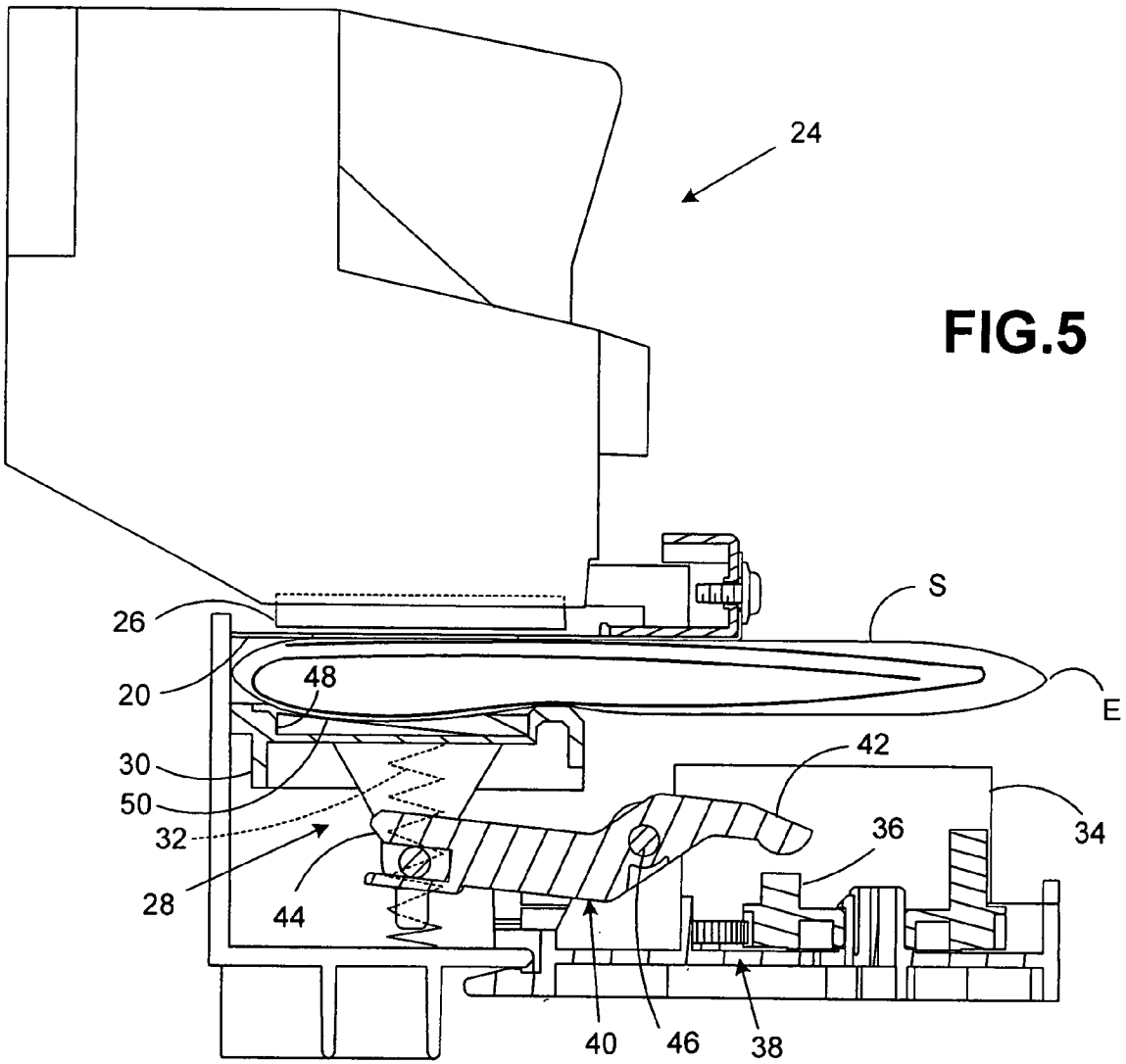
FIG. 5 is a view similar to FIG. 4, showing the print-related components in a condition to print the postage indicium on the envelope.

If the envelope is puffy, as illustrated in FIGS. 4 and 5, a bulge in the envelope is accommodated by the recess 48 in the platform 30 and the cantilever spring 50 is slightly depressed. Also, the platform is configured so that it only presses against the envelope at locations that correspond to solid portions of the registration plate. Because of the recess 48, it is unlikely that the envelope will be pushed up through the window 22 by the platform 30. In a case (not shown) where the envelope is thin, the cantilever spring 50 exerts a gentle upward force on the envelope to prevent the envelope from drooping into the recess 48. Thus proper registration of the envelopes can be achieved over a wide range of thicknesses of the envelopes.

With the envelope registered against registration plate 20, the print head is actuated to print the postage indicium on the envelope. The motor is then actuated once more to rotate the cam 36 so that the high end of the cam again holds up the end 42 of the follower arm 40, so as to withdraw the platform 30 from the registration plate 20. The operator then withdraws the envelope from the printing slot.

Although the cantilever spring is shown as mounted to the spring-loaded platform, other mounting arrangements may alternatively be provided. Although the cantilever spring is shown as planar and rectangular, other configurations of the cantilever spring may alternatively be employed.

The words "comprise," "comprises," "comprising," "include," "including," and "includes" when used in this specification and in the following claims are intended to specify the presence of stated features, elements, integers, components, or steps, but they do not preclude the presence or addition of one or more other features, elements, integers, components, steps, or groups thereof.

A number of embodiments of the present invention have been described. Nevertheless, it will be understood that various modifications may be made without departing from the spirit and scope of the invention. Other variations relating to implementation of the functions described herein can also be implemented. Accordingly, other embodiments are within the scope of the following claims.

What is claimed is:

1. A postage meter comprising:

a slot to receive insertion of an envelope;

a registration plate defining a top side of the slot, the registration plate having a window formed therein, the registration plate for defining a printing location for a top surface of the envelope;

a print head mounted above the registration plate for printing a postage indicium on the top surface of the envelope; and a spring-loaded platform having a top platform surface for pressing the envelope against the registration plate with a first force applied by the top platform surface, the spring-loaded platform top surface having a recess therein facing and substantially opposing at least a first portion of said window, said recess having a depth of at least about 5 mm and said recess including a biasing mechanism for pressing the envelope toward the window with a second force applied by the biasing mechanism, wherein the first force is greater than the second force.

2. The postage meter according to claim 1, further comprising:

the biasing mechanism comprises a cantilever spring positioned between said window and said recess for applying an upward force to the envelope.

3. The postage meter according to claim 2, wherein a lower edge of the cantilever spring is secured to a floor of said recess.

4. The postage meter according to claim 3, wherein the cantilever spring is a metal sheet.

5. The postage meter according to claim 4, wherein the cantilever spring is formed of stainless steel.

6. The postage meter according to claim 2, further comprising:

a switch adjacent the slot for being contacted by the envelope to actuate the print head; and a ramp at an end of the recess to guide the envelope to the switch.

7. The postage meter according to claim 2, wherein the cantilever spring has a length extent that is substantially equal to a length extent of said spring- loaded platform.

8. The postage meter according to claim 1, wherein the print head is an ink jet print head.

9. A postage meter comprising:

a slot to receive insertion of an envelope;

a registration plate defining a top side of the slot, the registration plate having a window formed therein, the registration plate for defining a printing location for a top surface of the envelope;

a print head mounted above the registration plate for printing a postage indicium on the top surface of the envelope;

a spring-loaded platform for contacting a bottom surface of the envelope and for pressing the envelope against the registration plate, wherein the spring-loaded platform does not contact at least a portion of the bottom surface of the envelope facing the window; and a cantilever spring at least partially in said slot for applying an upward force to at least a portion of the bottom surface of said envelope.

10. The postage meter according to claim 9, wherein a lower edge of the cantilever spring is secured to the spring loaded platform.

11. The postage meter according to claim 10, wherein the lower edge of the cantilever spring is secured to the spring-loaded platform at a floor of a recess formed in the spring-loaded platform.

12. The postage meter according to claim 11, wherein the recess is at least around 5 mm deep.

13. The postage meter according to claim 11, wherein the cantilever spring is a metal sheet.

14. The postage meter according to claim 13, wherein the cantilever spring is formed of stainless steel.

15. The postage meter according to claim 11, further comprising:

a switch adjacent the slot for being contacted by the envelope to actuate the print head; and a ramp at an end of the recess to guide the envelope to the switch.

16. The postage meter according to claim 9, wherein the cantilever spring has a length extent that is substantially equal to a length extent of said spring-loaded platform.

17. The postage meter according to claim 9, wherein said print head is an ink jet print head.

18. The postage meter according to claim 9, wherein the upward force applied to the envelope by the cantilever spring is less per area than applied by the spring-loaded platform.

19. The postage meter according to claim 11, wherein the recess is facing and substantially opposing at least a first portion of said window.

20. The postage meter according to claim 11, wherein the recess is facing and substantially opposing at least a first sub-portion of said window toward a trialing edge of said envelope.

* * * * *